United States Patent [19]

Fukutome et al.

[11] 4,206,590

[45] Jun. 10, 1980

[54] ELECTRONIC WRISTWATCH CASE

[75] Inventors: Satoru Fukutome; Yasuo Maekawa, both of Tanashi, Japan

[73] Assignee: Citizen Watch Company Limited, Tokyo, Japan

[21] Appl. No.: 921,310

[22] Filed: Jul. 3, 1978

[30] Foreign Application Priority Data

Jul. 9, 1977 [JP] Japan ..... 52-91439[U]

[51] Int. Cl.[2] ..... G04C 21/34

[52] U.S. Cl. ..... 368/72; 368/74

[58] Field of Search ..... 58/16, 19 R, 53, 57.5, 58/38 R, 88 R, 88 C, 88 E, 90 R, 94; 340/384 R, 384 E, 358, 391

[56] References Cited

U.S. PATENT DOCUMENTS

| | | | |
|---|---|---|---|
| 3,577,876 | 5/1971 | Spadini | 58/57.5 |
| 3,777,472 | 12/1973 | Iinuma | 58/57.5 |
| 3,879,931 | 4/1975 | Yasuda et al. | 58/38 |
| 4,068,461 | 1/1978 | Tassett et al. | 58/23 R |

*Primary Examiner*—Vit W. Miska

*Attorney, Agent, or Firm*—Jordan and Hamburg

[57] ABSTRACT

An electronic wristwatch case construction in which a sound-emitting cover has a battery replacement hole and a plurality of sound-emitting holes. A fixing ring is disposed in concentric relationship with respect to the battery replacement hole of the sound-emitting cover, and a vibrating plate cooperating with a piezoelectric vibrating element for an alarm is spaced from the sound-emitting cover. A battery hatch is detachably fastened to the fixing ring, and a sealing ring is disposed between the battery hatch and the fixing ring to provide a water-tight sealing therebetween.

8 Claims, 5 Drawing Figures

ELECTRONIC WRISTWATCH CASE

This invention relates to an electronic timepiece equipped with an alarm, and more particularly to an electronic wristwatch case.

There is well known in the art an alarm-type timepiece in which a vibrating plate is secured to the bottom portion of a watch case and caused to vibrate by means of a piezoelectric element in order to produce an alarm. In the timepiece of this type, various shortcomings have been encountered as will be described later in detail.

It is, therefore, an object of the present invention to provide an improved case construction for an electronic wristwatch, which case overcomes the shortcomings encountered in prior art.

It is another object of the present invention to provide an electronic wristwatch case which makes it possible to simplify the battery replacement and facilitate handling at the time of installation and removal of the watch movement.

Figure 1:
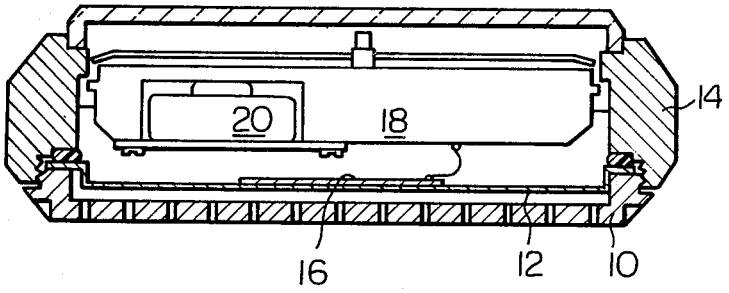
Fig. 1 PRIOR ART
FIG. 1 is a partially cross-sectional view of a watch case according to the prior art.

An example of a conventional watch case is shown in FIG. 1. The watch case has a vibrating plate 12 supported between a sound-emitting cover 10 and a case band 14, and a piezoelectric vibrating element 16 fixed to the inward side of the vibrating plate. The vibrating plate 12 vibrates responsive to electric signals from a movement 18 to produce an alarm.

In this conventional structure, a battery 20 is disposed on the inward side of the vibrating plate 12. This results in an after-sale servicing problem since both the vibrating plate 12 and the sound-emitting cover 10 must be removed from the case band 14 whenever the battery 20 is replaced. Moreover, removal of the vibrating plate and sound-emitting cover from the case band 14 allows contaminants such as dust and pieces of waste thread from the external environment to invade and attach to the movement 18. This is a prime cause of movement malfunction. Another factor for consideration is the design and aesthetic appearance of the watch case. Specifically, the vertically stacked arrangement of the battery 20 and vibrating plate 12 in the conventional timepiece added to the overall thickness of the case and thus detracted from both design and appearance.

Accordingly, in view of the shortcomings encountered in the prior art, the present invention proposes to simplify the battery replacement operation which was a troublesome operation in the prior art, maintain the quality of the movement by not permitting dust or pieces of waste thread to attach thereto, and facilitate handling at the time of installation and removal of the movement by unifying the vibrating plate and sound-emitting cover into a single unit.

Figure 2:
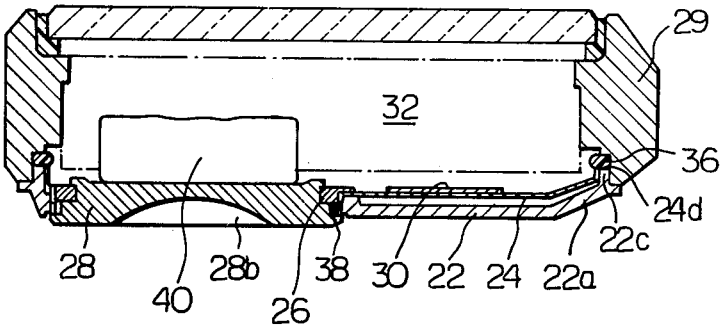
FIG. 2 is a cross-sectional view of a preferred embodiment of a watch case according to the present invention.
Figure 3:
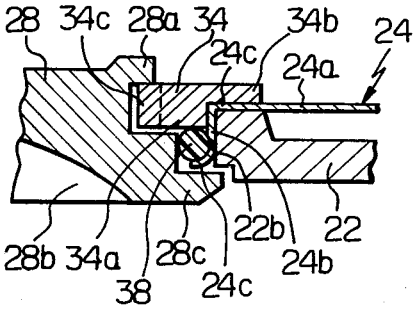
FIG. 3 is an expanded cross-sectional view of the principal portion of FIG. 2.

A preferred embodiment of a watch case according to the present invention is illustrated in FIGS. 2 and 3.

In FIGS. 2 and 3, reference numeral 22 denotes a sound-emitting cover, 24 a vibrating plate comprising a thin plate of titanium or stainless steel, 26 a fixing ring, 28 a battery hatch and 30 a case band.

The sound-emitting cover 22 is detachably fastened to case band 29 by press fitting and has a plurality of sound-emitting holes 22*a* formed in its bottom as well as a battery replacement through-hole 22*b* provided in its central portion in order to allow the insertion and securing of the fixing ring 26. Vibrating plate 24 has substantially the same configuration as sound-emitting cover 22 and includes a flat portion 24*a* substantially, parallel to the cover 22, and an axially extending cylindrical portion 24*b* serving as a O-ring compression portion and concentric with battery replacement through-hole 22*b* of sound-emitting cover 22. The cylindrical portion 24*b* is received in the through-hole 22*b* of cover 22 and has at its lower end formed with a radially, inwardly extending flange portion 24*c* serving as a connecting portion. A piezoelectric vibrating element 30 is fixed to the inward side of vibrating plate 24 and is electrically connected to movement 32 supported by case band 29. Fixing ring 34 has an annular axial projection 34*a* fixedly inserted into cylindrical portion 24*b* of vibrating plate 24, and an annular flange 34*b* radially outwardly extending from axial projection 34*a*. The inward side of the axial projection 34*a* is provided with an engaging portion 34*c* for engaging with the bayonet projection 28*a* of battery hatch 28.

Fixing ring 34 and vibrating plate 24 are fixedly connected to one another into one piece by spot welding ring connecting portion 24*c* to connecting portion 34*b*. The outer edge portion 24*d* of vibrating plate 24 is secured to case band 29 through a packing 36 at a press-fitting portion 22*c* of the sound-emitting cover 22. Battery hatch 28 is secured by a bayonet mechanism to fixing ring 34 via a sealing ring such as an O-ring 38. The cylindrical portion 24*b* of vibrating plate 24 is positioned between O-ring 38 and the side wall of through-hole 22*b* of sound-emitting cover 22, the O-ring thereby preventing the invasion of water along the side surface of battery hatch 28 and the cylindrical portion 24*b*. Accordingly, in so far as the conditions for connecting the fixing ring 34 to vibrating plate 24 are concerned, it suffices to consider only the fixing force and not waterproofness. A vabrating plate made of titanium need not be soldered to fixing ring 34, so that an important structural advantage is provided.

As stated above, sound-emitting cover 22, vibrating plate 24 and fixing ring 34 are integrated and handled as a single unit; when vibrating plate 24 sustains damage, fixing ring 34 is dismantled from sound-emitting cover 22. Battery 40 can be replaced by removing battery hatch 28 from sound-emitting cover 22. This is similar to the battery replacement practice in a conventional battery hatch-equipped electronic timepiece. When movement 32 is to be removed the sound-emitting cover is removed in the same manner as the back cover of the conventional timepiece.

Figure 4:
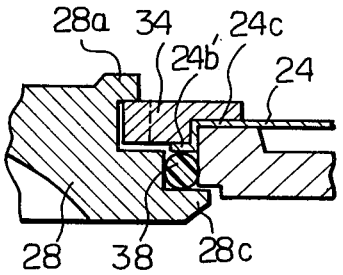
FIG. 4 is an expanded cross-sectional view of a modification of the principal portion shown in FIG. 3.

FIG. 4 illustrates a modified form of case structure shown in FIG. 3. Except for the fact that the O-ring compression portion 24*b* of vibrating plate 24 is located at a position different from that of the foregoing embodiment, the two embodiments are identical structurally. The O-ring compression portion 24*b*′ of the modification shown in FIG. 4 is located between fixing ring 34 and O-ring 38 to prevent the invasion of water from the outside with the annular radial flange 28c of battery hatch 28 engaging the O-ring 38.

Figure 5:
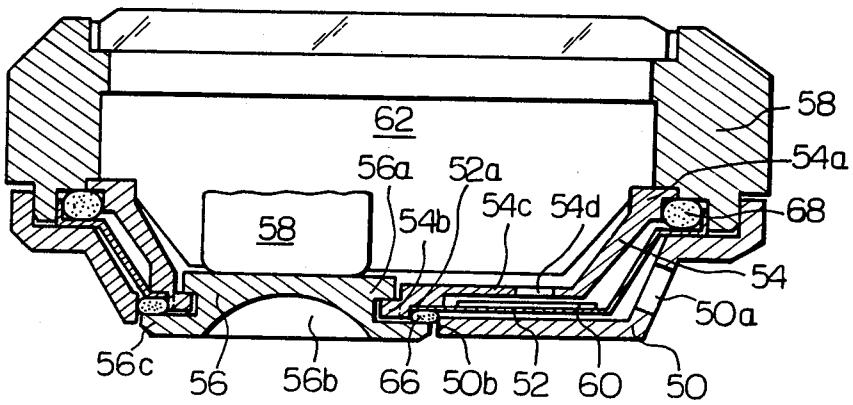
FIG. 5 is a cross-sectional view of another preferred embodiment of a watch case according to the present invention.

FIG. 5 shows another preferred embodiment of a watch case according to the present invention. In FIG. 5, reference numeral 50 denotes a sound-emitting cover, 52 a vibrating plate, 54 an intermediate frame serving as a fixing ring and 56 a battery hatch.

The sound-emitting cover 50 is detachably fastened to a case band 58 by press fitting and has a plurality of sound-emitting holes 50a formed in its inclined side portions as well as a battery replacement through-hole 50b provided in its bottom portion in order to allow the installation and removal of battery 58. Through-hole 50b is large enough the accommodate a flange 56c formed about the battery hatch 56. Vibrating plate 52 has substantially the same horizontal configuration as sound-emitting cover 50 and includes a hole 52a approximately concentric with through-hole 50b of sound-emitting cover 50. A piezoelectric vibrating element 60 is fixed to the inward side of vibrating plate 52 and is electrically connected to movement 62. Intermediate frame 54 has an outer peripheral portion 54a for supporting movement 62, and an engaging portion 54b located on its bottom and adapted to engage with a bayonet projection 56b on the battery hatch 56. Provided through the flat portion 54c of the intermediate frame 54 is a hole 54d through which a wire lead or the like is passed so that electric signals can be transmitted from movement 62 to piezoelectric vibrating element 60, the flat portion 54c being spaced apart from vibrating plate 52 to define a small air gap therewith, whereby the flat portion 54c serves as a reinforcing member to prevent deformation of the vibrating plate 52 when an external force attempts to deform the same. Battery hatch 56 has bayonet projection 56a, coin groove 56b formed in its central portion, and flange portion 56c for compressing an O-ring 66, the battery hatch being connected to engaging portion 54b of intermediate frame 54 by means of the bayonet mechanism. Vibrating plate 52 is secured to case band 58 through an O-ring 68 by the press-fitting attachment of sound-emitting cover 50 to case band 58, the O-ring 68 being compressed in the axial direction to maintain an air-tight seal between case band 58 and vibrating plate 52. The vibrating plate 52 is also secured to intermediate frame 54 through O-ring 66 by attaching battery hatch 56 to the intermediate frame by the bayonet means, with O-ring 66 being compressed in the axial direction to maintain an air-tight condition between battery hatch 56 and vibrating plate 52. The peripheral portion of vibrating plate 52 about hole 52a may be spot welded to intermediate frame 54, and the outer peripheral portion of the vibrating element spot welded to sound-emitting cover 50.

While the sound-emitting cover according to the foregoing embodiments is attached to the lower portion of the case band, embodiments can be conceived in which the cover is attached to the bottom portion of the band or the upper or side portion of the case band. It is also possible to attach battery hatch to fixing ring by press-fitting or screw means in stead of the bayonet means.

The present invention as described above makes it possible to simplify battery replacement which heretofore was a problem in after-sale servicing, and allows battery replacement to be accomplished without contaminants such as dust attaching to the movement. The present invention also makes it possible to facilitate handling during the installation and removal of the movement. The overall timepiece thickness can be reduced since the battery hatch is disposed in the through-hole of the sound-emitting cover. Moreover, since the intermediate frame is disposed in close proximity to the vibrating plate on its inward side and thus serves as a reinforcing plate, the frame prevents the vibrating plate and piezoelectric element from sustaining damage due to externally applied forces and also prevents the deformation of the movement.

What is claimed is:

1. A case construction for an electronic wristwatch powered by a battery, comprising:

a case band;

a sound-emitting cover detachably fastened to said case band and including a battery replacement through-hole and a plurality of sound-emitting holes;

a fixing ring disposed in concentric relationship with said battery replacement through-hole and including an engaging portion;

a battery hatch removably engaging with the engaging portion of said fixing ring;

a vibrating plate fixed to said fixing ring and disposed in spaced relationship with respect to said sound-emitting cover, said vibrating plate including a sealing ring compression portion received in the through-hole of said sound-emitting cover;

a sealing ring disposed between the sealing ring compession portion of said vibrating plate and said battery hatch to provide a watertight sealing effect therebetween; and a piezoelectric vibrating element mounted on said vibrating plate.

2. A case construction as claimed in claim 1, in which said sealing ring compression portion is disposed between said sealing ring and said battery replacement through-hole.

3. A case construction as claimed in claim 1, in which said sealing ring compression portion is disposed between said sealing ring and said fixing ring.

4. A case construction as claimed in claim 1, in which said vibrating plate is fixed to said fixing ring by welding.

5. A case construction as claimed in claim 1, in which said vibrating plate has its outer periphery disposed between said case band and said sound-emitting cover.

6. A case construction as claimed in claim 3, further comprising a second sealing ring compressed between said case band and said vibrating plate.

7. A case construction as claimed in claim 4, in which said fixing ring comprises an intermediate frame having its outer periphery disposed between said case band and said second sealing ring.

8. A case construction for an electronic wristwatch powered by a battery, comprising:

a case band;

a sound-emitting cover detachably fastened to said case band and including a battery replacement through-hole and a plurality of sound-emitting holes;

a fixing ring disposed in concentric relationship with said battery replacement through-hole and including an engaging portion;

a battery hatch removably engaging with the engaging portion of said fixing ring;

a vibrating plate fixed to said fixing ring and disposed in spaced relationship with respect to said sound-emitting cover, said vibrating plate including an axially extending cylindrical portion serving as a sealing ring compression portion said axially extending cylindrical portion being received in the through-hole of said sound-emitting cover;

a sealing ring disposed between said axially extending cylindrical portion of said vibrating plate and said battery hatch to provide a water-tight sealing effect therebetween; and a piezoelectric vibrating element mounted on said vibrating plate.

* * * * *